US008833281B2

(12) United States Patent
Widell et al.

(10) Patent No.: US 8,833,281 B2
(45) Date of Patent: Sep. 16, 2014

(54) TEXTURE HOOP FIXTURE

(75) Inventors: Kerstin Widell, Huskvarna (SE); Ann-Sofi Elonsson, Huskvarna (SE); Maria Strahl, Jonkoping (SE); Philip Oglesby, Quitman, TX (US)

(73) Assignee: VSM Group AB, Huskvarna (SE)

( * ) Notice: Subject to any disclaimer, the term of this patent is extended or adjusted under 35 U.S.C. 154(b) by 1020 days.

(21) Appl. No.: 12/791,822

(22) Filed: Jun. 1, 2010

(65) Prior Publication Data

US 2011/0113999 A1 May 19, 2011

Related U.S. Application Data

(60) Provisional application No. 61/213,353, filed on Jun. 1, 2009.

(51) Int. Cl.
*A41D 1/04* (2006.01)
*D05C 7/08* (2006.01)
*D05C 9/04* (2006.01)

(52) U.S. Cl.
CPC ... *D05C 7/08* (2013.01); *D05C 9/04* (2013.01)
USPC ..... 112/103

(58) Field of Classification Search
USPC ..... 112/102, 103, 104, 102.5, 118, 119, 112/475.04, 475.18, 475.19
See application file for complete search history.

(56) References Cited

U.S. PATENT DOCUMENTS 286,662 A 10/1883 Wendell
590,726 A 9/1897 Merrick
3,550,544 A 12/1970 Fairfield et al.
3,570,426 A 3/1971 Kunes
3,585,950 A 6/1971 Ito
3,589,320 A 6/1971 Beazley
3,592,153 A 7/1971 Margereson
3,613,608 A 10/1971 Hinerfeld et al.
3,613,610 A 10/1971 Hinerfeld et al.
3,664,288 A * 5/1972 Weidlin Von Boden et al. ..... 112/103
3,698,334 A 10/1972 Kleinschmidt et al.
3,721,204 A 3/1973 Schaffer et al.
3,727,567 A 4/1973 Beazley
3,763,805 A 10/1973 Weigert
3,799,087 A 3/1974 Beamish et al.
3,818,849 A 6/1974 Maddox, Jr.

(Continued)

FOREIGN PATENT DOCUMENTS

DE 102007001073 A1 8/2007
EP 39680 A1 11/1981

(Continued)

*Primary Examiner* — Tejash Patel
(74) *Attorney, Agent, or Firm* — Lando & Anastasi, LLP

(57) ABSTRACT

A texture hoop for use in a sewing machine which aids the application of ribbons, yarns and other embellishments within a design. The texture hoop has a fixture with a central opening. A base fabric to receive embellishments is stretched across the central opening and affixed to the fixture edges. Embellishments are positioned upon the base fabric to achieve a pleasing design. The embellishments are then readily secured in the texture hoop fixture at the desired locations and laying upon the base fabric. A stitch pattern is then applied to sew the embellishments to the base fabric by manipulating the fixture with base fabric and secured embellishments beneath the sewing machine presser foot. The texture hoop may also be used in conjunction with automated stitch patterns and embroidery elements available in processor controlled machines.

15 Claims, 15 Drawing Sheets

(56) References Cited

U.S. PATENT DOCUMENTS

| | | | | |
|---|---|---|---|---|
| 3,904,890 | A | 9/1975 | Wenrich et al. | |
| 3,967,566 | A | 7/1976 | Spiegel et al. | |
| 4,098,208 | A | 7/1978 | Hedegaard | |
| 4,116,145 | A | 9/1978 | Nicolay | |
| 4,185,575 | A | 1/1980 | Brown et al. | |
| 4,214,540 | A | 7/1980 | Cook | |
| 4,246,858 | A | 1/1981 | Ogawa | |
| 4,324,191 | A | 4/1982 | Brown | |
| 4,373,458 | A | 2/1983 | Dorosz et al. | |
| 4,409,914 | A | 10/1983 | Sansone | |
| 4,412,498 | A | 11/1983 | Scholl | |
| 4,414,909 | A | 11/1983 | Bray | |
| 4,426,947 | A | 1/1984 | Marshall | |
| 4,467,739 | A | 8/1984 | Hager et al. | |
| 4,479,448 | A | 10/1984 | Jones et al. | |
| 4,502,400 | A | 3/1985 | Walther | |
| 4,503,794 | A | 3/1985 | Ishihara et al. | |
| 4,519,331 | A | 5/1985 | Kosrow et al. | |
| 4,569,297 | A | 2/1986 | Dusch | |
| 4,648,337 | A | 3/1987 | Mall | |
| 4,677,926 | A | 7/1987 | Dusch et al. | |
| 4,686,917 | A | 8/1987 | Braun | |
| 4,706,587 | A | 11/1987 | Shiomi | |
| 4,726,309 | A | 2/1988 | Popp | |
| 4,803,937 | A | 2/1989 | Hiramatsu et al. | |
| 4,867,082 | A | 9/1989 | Sabbioni et al. | |
| 5,138,962 | A | 8/1992 | Klundt | |
| 5,481,995 | A | 1/1996 | Hiratsuka et al. | |
| 6,189,989 | B1 | 2/2001 | Hirabayashi et al. | |
| 6,394,012 | B1 * | 5/2002 | French et al. | 112/103 |
| 6,736,077 | B2 | 5/2004 | Pokrishevsky et al. | |
| 7,240,628 | B2 | 7/2007 | Friman et al. | |
| 7,255,052 | B2 * | 8/2007 | Okazaki | 112/103 |
| 7,506,596 | B2 * | 3/2009 | Bowlus | 112/103 |
| 7,918,169 | B2 * | 4/2011 | Mack et al. | 112/103 |
| 7,966,957 | B2 * | 6/2011 | Mack et al. | 112/103 |
| 8,245,654 | B2 * | 8/2012 | Konig et al. | 112/103 |
| 8,387,547 | B2 | 3/2013 | Bardh et al. | |
| 2003/0140830 | A1 | 7/2003 | Pokrishevsky et al. | |
| 2007/0245940 | A1 | 10/2007 | Wahlstrom | |
| 2007/0272135 | A1 | 11/2007 | Fujihara | |
| 2011/0094426 | A1 | 4/2011 | Eklund et al. | |

FOREIGN PATENT DOCUMENTS

| | | | |
|---|---|---|---|
| EP | 1777331 | A1 | 4/2007 |
| GB | 191124452 | A | 8/1912 |
| GB | 1179964 | A | 2/1970 |
| GB | 1179965 | A | 2/1970 |
| GB | 1182563 | A | 2/1970 |
| GB | 1200024 | A | 7/1970 |
| GB | 1282153 | A | 7/1972 |
| GB | 1310091 | A | 3/1973 |
| GB | 1315001 | A | 4/1973 |
| GB | 1320765 | A | 6/1973 |
| GB | 1375540 | A | 11/1974 |
| GB | 1393294 | A | 5/1975 |
| GB | 1440350 | A | 6/1976 |
| GB | 2028388 | A | 3/1980 |
| GB | 2043124 | A | 10/1980 |
| GB | 1583629 | A | 1/1981 |
| JP | 6304359 | A | 7/2007 |
| WO | 8101020 | A1 | 4/1981 |
| WO | 8203879 | A1 | 11/1982 |
| WO | 8901067 | A1 | 2/1989 |

* cited by examiner

TEXTURE HOOP FIXTURE

CROSS-REFERENCE TO RELATED APPLICATION

This application claims the benefit of U.S. Provisional Application Ser. No. 61/213,353, filed on Jun. 1, 2009, the entirety of which is hereby incorporated herein by reference.

BACKGROUND OF THE INVENTION

1. Field of the Invention

The present invention generally relates to an apparatus and method to add embellishments and embroidery upon a fabric with a sewing machine. More particularly, the present invention relates to a hoop fixture to position and clamp embellishments while being sewn to a base fabric.

2. Description of the Related Art

A modern sewing machine is able to produce a variety of stitches and stitch patterns on demand. The feeding of fabric into the machine may be manually controlled by hand, or the feeding of the fabric may be processor controlled. A processor controlled sewing and embroidery machine is able to produce a variety of stitch patterns or embroidery elements by selection from a database. A stitch pattern is an entity composed of a number of stitches. A number of stitches may also be used to form an embroidery element. The embroidery element combines the stitches or stitch patterns to form a desired shape or appearance on the base fabric. Embroidery elements may take any shape and use any combination of stitches or stitch patterns.

In embroidering a fabric using a processor controlled embroidery machine it is possible to use ready designed embroidery elements which are stored as data in a memory, either in the embroidery machine or in an external memory unit. Such embroidery elements can be combined and programmed to succeed one another in order to generate a desired composite embroidery pattern. Examples of the combination of embroidery elements are given in the document U.S. Pat. No. 4,352,334 which discloses a method of combining embroidery elements, in this case embroidered letters. It is also possibly to embroider using a manually controlled machine by free hand feeding of the fabric into the machine to achieve the desired shape.

A selection of pre-designed stitches, stitch patterns and embroidery elements are included with the processor controlled sewing and embroidery machine. A manually controlled sewing machine includes a selection of stitches and stitch patterns. Advanced embroidery sewing machines provide tools for creating new embroidery elements by combining existing stitches, stitch patterns, or embroidery elements. Data for each individual stitch, stitch pattern, or embroidery element can be reproduced as a graphic representation on a display, which may be integrated with the sewing machine. Such graphic representation of a stitch, a stitch pattern, or an embroidery element is referred to herein as a stitch graphic, stitch pattern graphic, or embroidery graphic respectively. By freely selecting a combination of the graphics above and by joining these together in a group, a more complex stitch pattern, or embroidery element may be designed. The sequence of selected graphics and associated data may then be stored in memory as a new stitch pattern or embroidery graphic.

The processor controlled sewing and embroidery machine is provided with a processor, a control program, and a memory. The control program may be integral with the processor or stored in memory. The memory is accessible by the processor and may either be accommodated within the machine or may be external. Data for each individual stitch, stitch pattern, or embroidery element is stored in a database within the memory. A display is provided upon which the graphic elements representing the stitch, stitch patterns, or embroidery elements may be displayed to the user.

When performing embroidery, the machine uses an embroidery frame or hoop to hold the base fabric to receive the embroidery element. The base fabric is stretched and secured around the periphery of the hoop. The embroidery hoop is then mounted to an embroidery unit which may be integral with the machine and which is controlled by the machine processor. In some applications, the embroidery unit may also be separate from the machine. When mounted, the plane of the embroidery hoop is generally perpendicular to the axis of the sewing needle stroke. The embroidery unit contains mechanisms for movement of the embroidery hoop in perpendicular X and Y directions within the plane of the hoop. The position of the embroidery hoop relative to the sewing needle is controlled by the processor and is referenced to an X and Y coordinate axes. The position of the embroidery hoop at any time is expressed within the processor as an X coordinate value and a Y coordinate value. During a sewing or embroidery operation, the machine processor accesses the stored data and signals the embroidery unit to move the embroidery hoop in corresponding X and Y coordinate displacements to produce the desired stitch, stitch pattern, or embroidery elements.

In sewing or embroidery, it is often desirable to attach ribbons or yarns to the base fabric. These additional elements, referred to herein as embellishments, may be in many textures, thicknesses and widths. Any combination of embellishments, embroidery elements, stitches or stitch patters, are referred to herein as a design. Other embellishments such as patches, emblems, and the like may also be incorporated within a design. Such embellishments add a 3-dimensional effect, or texture, to the completed design. In the prior art, in both manual and processor controlled sewing and embroidery machines, it is difficult to incorporate embellishments upon the base fabric using an embroidery hoop. For example, a ribbon laid across the embroidery hoop may not readily lie adjacent to the base fabric, may change position during sewing or embroidery, and will often be lifted by or become entangled with the presser foot of the sewing machine. To aid in developing a design, embellishments need to be readily positioned upon the base fabric, and repositioned or manipulated as desired.

The precise positioning of the embellishment within a design is also problematic. In a manually fed sewing machine, the embellishment may move about during the sewing operation and the relative positions and orientations of embellishments is difficult to gauge by eye. In a processor controlled sewing machine, it is difficult to judge the position of an embellishment relative to the X-Y embroidery hoop coordinates. In the example above, a stitch pattern may be programmed into the machine to secure the ribbon to the base fabric. The command is then executed by the machine and a stitch pattern is performed securing the ribbon to the fabric. Upon post inspection, the stitch pattern may not be aligned or centered upon the ribbon producing an unattractive effect.

A design which incorporates both embroidery elements and embellishments is also problematic in the current art. The location of the embroidery element within the design is difficult to judge, and as above, the position of the embellishment relative to the embroidery element is difficult to control. Moreover, a portion of the embroidery element may cover the embellishment. The embroidery element typically has numerous stitch patterns which increases the opportunity for the embellishment to move or become entangled with the foot of the machine as the processor controls the movement of the embroidery hoop.

Due to the problems above in the prior art, designs incorporating texture via embellishments were often seen as too difficult to produce in both manually controlled and processor controlled machines. According, it would be advantageous to provide a device and method to allow the inclusion of embellishments within a design. Such a device would allow the ready positioning and re-positioning of embellishments when developing a design. In a manually operated sewing machine, the device would positively secure the embellishments in position during a sewing operation. The device would also allow embellishments to be used with a processor controlled sewing and embroidery machine. Such a device and method would allow the precise position of embellishment within the design and ensure the embellishment does not interfere with a subsequent stitching or embroidery operation. The device and method should also allow the use of embroidery elements adjacent and upon the embellishments. It is thus to such a texture hoop device and method that the present invention is primarily directed.

SUMMARY OF THE INVENTION

The disadvantages of the prior art are overcome by the present invention which, in one aspect, is a texture hoop for use in a sewing machine. The sewing machine has a presser foot and the texture hoop includes a fixture for securing the fabric. The fixture has a central opening and the fabric is stretched across the central opening and affixed to the fixture edges. The texture hoop has a means for securing at least one embellishment to the fixture. The embellishment laying upon the base fabric when secured in place. A stitch pattern can then be applied to sew the embellishment to the base fabric by manipulating the fixture with base fabric and secured embellishment beneath the sewing machine presser foot.

The means for securing the embellishment to the fixture may include a protruding lip on the fixture. A spring clip configured to engage the protruding lip. The embellishment may then be placed at a desired position upon the base fabric and clamped to the fixture at the protruding lip by the spring clip. The fixture may also include a plurality of recesses spaced adjacent the central opening and into which embellishments may be received and positively positioned. The recesses may be evenly spaced at intervals along the edges of the fixture. The means for securing the embellishment to the fixture may include securing the embellishment within at least one of the recesses spaced adjacent the central opening. The means for securing the embellishment to the fixture may include at least one of a spring clip, a magnet, a wedge, a pin, or a hook. The texture hoop fixture may include a first inner hoop and a second outer hoop. The inner and outer hoops have a central opening and are configured to have a base fabric stretched across the central opening and clamped between the first inner hoop and the second outer hoop.

In another aspect, the present invention presents a texture hoop fixture for use in a processor controlled sewing machine. The sewing machine has a processor controlled embroidery unit configured for moving the texture hoop fixture along perpendicular first and second coordinate axes relative to the sewing needle. The texture hoop fixture has a mounting lug for mounting the texture hoop upon the embroidery unit.

The texture hoop also has an inner and outer hoop with a central opening therein. The hoops are configured to have a base fabric stretched across the central opening and to be clamped between the inner and outer hoop. The position of the texture hoop fixture relative to the sewing needle is processor controlled along the perpendicular coordinate axes of the embroidery unit. Each coordinate axis being divided into coordinate units relative to an origin. The needle position relative to the fixture is then expressed in the processor as a first coordinate value along the first axis, and a second coordinate value along the second axis.

The texture hoop fixture also has a means for securing the embellishment to the texture hoop fixture and positional references for relating the location of embellishments positioned upon the base fabric to the units of each coordinate axis. When an embellishment is positioned in a desired location upon the base fabric and secured within the texture hoop fixture, a stitch pattern start and end location coordinate values to secure the embellishment to the base fabric may be determined by using the positional references of the texture hoop fixture.

The texture hoop fixture includes the coordinate units of the first and second coordinate axes and axes origin marked upon the texture hoop fixture. The positional references include a semi-transparent template. The template is configured to be received in the central opening of the fixture and has the coordinate units of the first and second coordinate axes marked upon it. The positional references also include a semi-transparent template configured to be received in the central opening of the fixture and having the coordinate origin of the first and second coordinate axes marked upon it.

The positional references on the texture hoop fixture include a plurality of recesses spaced around the central opening and into which embellishments may be received and positively positioned. The recesses are evenly spaced at positions corresponding to the coordinate units. The means for securing the embellishment to the texture hoop include securing the embellishment within at least one of the recesses spaced around the central opening. The means of securing the embellishment to the texture hoop include at least one of a spring clip, a magnet, a wedge, or a hook. The clamping means for securing the embellishment to the texture hoop may further include a protruding lip on the hoop fixture. One or more spring clips configured to engage the protruding lip. Embellishments may then be placed at a desired position on the base fabric and secured to the texture hoop at the protruding lip by the spring clips.

In another aspect, the present invention presents a method of sewing an embellishment to a base fabric using a processor controlled sewing machine and a texture hoop fixture. The sewing machine having a processor controlled embroidery unit configured for moving a texture hoop fixture along perpendicular first and second coordinate axes relative to the sewing needle. The texture hoop fixture has a mounting lug for mounting the texture hoop upon the embroidery unit and including a first inner hoop and a second outer hoop. The inner and outer hoops have a central opening therein across which a base fabric is stretched. The base fabric is clamped between the first inner hoop and the second outer hoop.

The position of the texture hoop fixture relative to the sewing needle is processor controlled along the perpendicular coordinate axes of the embroidery unit. Each coordinate axis is divided into coordinate units relative to an origin. The needle position relative to the fixture is then expressed in the processor as a first coordinate value along the first axis, and a second coordinate value along the second axis. Positioning an embellishment in a desired location upon the base fabric and securing the embellishment in position within the texture hoop fixture. A stitch pattern start location coordinate values and end location coordinate values are determined using positional references of the texture hoop fixture. The positional references relate the location of embellishments positioned upon the base fabric to the units of each coordinate axis. The stitch pattern begins at a start location corresponding to a starting first and second coordinate value and extends to an end location which corresponds to an ending first and second coordinate value. The sewing machine is then programmed with at least one stitch pattern to secure the embellishment to the base fabric which begins at the starting first and second coordinate value and extends to the ending first and second coordinate value. The sewing machine then executes the program to secure the embellishment to the base fabric using the stitch pattern.

In another aspect, the step of determining the stitch pattern start and end location coordinate values include using the coordinate units of the first and second coordinate axes as marked upon the texture hoop fixture. The step may also include using a semi-transparent template. The template is placed in the central opening of the texture hoop fixture and upon the base fabric and embellishment. The template has the coordinate units of the first and second coordinate axes marked thereon and the embellishment location is visible through the template. The step may also include referencing a plurality of recesses spaced around the central opening of the inner hoop and into which embellishments may be received and positively positioned. The recesses being evenly spaced at positions corresponding to the axes coordinate units.

In yet another aspect, the step of securing the embellishment within the texture hoop fixture includes using at least one of a spring clip, a magnet, a wedge, or a hook. The step may also include a protruding lip on the hoop fixture with one or more spring clips configured to engage the protruding lip. Placing an embellishment at a desired position on the base fabric and clamping the embellishment to the protruding lip using at least one of the spring clips.

In yet another aspect, the step of securing the embellishment within the texture hoop fixture includes a plurality of recesses spaced around the central opening and into which embellishments may be received and positively positioned, the recesses being evenly spaced at positions corresponding to the axes coordinate units. The step of securing the embellishment within the texture hoop fixture includes placing an embellishment within a recess and securing in place with at least one spring clip.

In another aspect, the present invention presents a method of sewing an embellishment to a base fabric using a sewing machine and a texture hoop. The sewing machine has a presser foot and is configured for manually feeding the fabric into the machine. A fixture is used which has a first inner hoop and a second outer hoop. The inner and outer hoops have a central opening. The base fabric to receive the embellishment is stretched across the central opening and clamped between the inner and outer hoops. Embellishments are then positioned upon the base fabric. Each embellishment is secured to the fixture to lie upon and adjacent the base fabric. The embellishment is then sewn to the base fabric with a stitch pattern by manipulating the fixture with base fabric and secured embellishment beneath the sewing machine presser foot.

In yet another aspect, the present invention presents a method of sewing an embellishment to a base fabric using a processor controlled sewing machine and a texture hoop fixture. The sewing machine having a processor controlled embroidery unit configured for moving a texture hoop fixture along perpendicular first and second coordinate axes relative to the sewing needle. The texture hoop fixture has a mounting lug for mounting the texture hoop upon the embroidery unit and including a first inner hoop and a second outer hoop. The inner and outer hoops have a central opening therein across which a base fabric is stretched. The base fabric is clamped between the first inner hoop and the second outer hoop.

The position of the texture hoop fixture relative to the sewing needle is processor controlled along the perpendicular coordinate axes of the embroidery unit. Each coordinate axis is divided into coordinate units relative to an origin. The needle position relative to the fixture is then expressed in the processor as a first coordinate value along the first axis, and a second coordinate value along the second axis. Selecting a position for an embroidery on the base fabric. Determining the embroidery location coordinate values by use of the positional references on the texture hoop fixture. The positional references relate the embroidery location to the units of each coordinate axis. Programming the sewing machine with a first and second coordinate value which corresponds to the embroidery location. Executing the program to sew the embroidery element upon the base fabric at the location coordinate value.

In yet another aspect, the step of determining the embroidery location coordinate values includes using a semi-transparent template. The template is placed in the central opening of the texture hoop fixture and upon the base fabric. The template has the coordinate units of the first and second coordinate axes marked thereon. The step may also include using the coordinate units of the first and second coordinate axes as marked upon the texture hoop fixture.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

The texture hoop device and method provides a way to combine embellishments within a design while still using the processor controlled stitching and embroidery features of the machine. The device allows for the precise positioning and clamping of multiple embellishments within a design and ensures the embellishments will not interfere with subsequent sewing or embroidery operations. The device also aids in the layout and visualization of designs which use stitch patterns, embroidery elements and embellishments.

Figure 1:
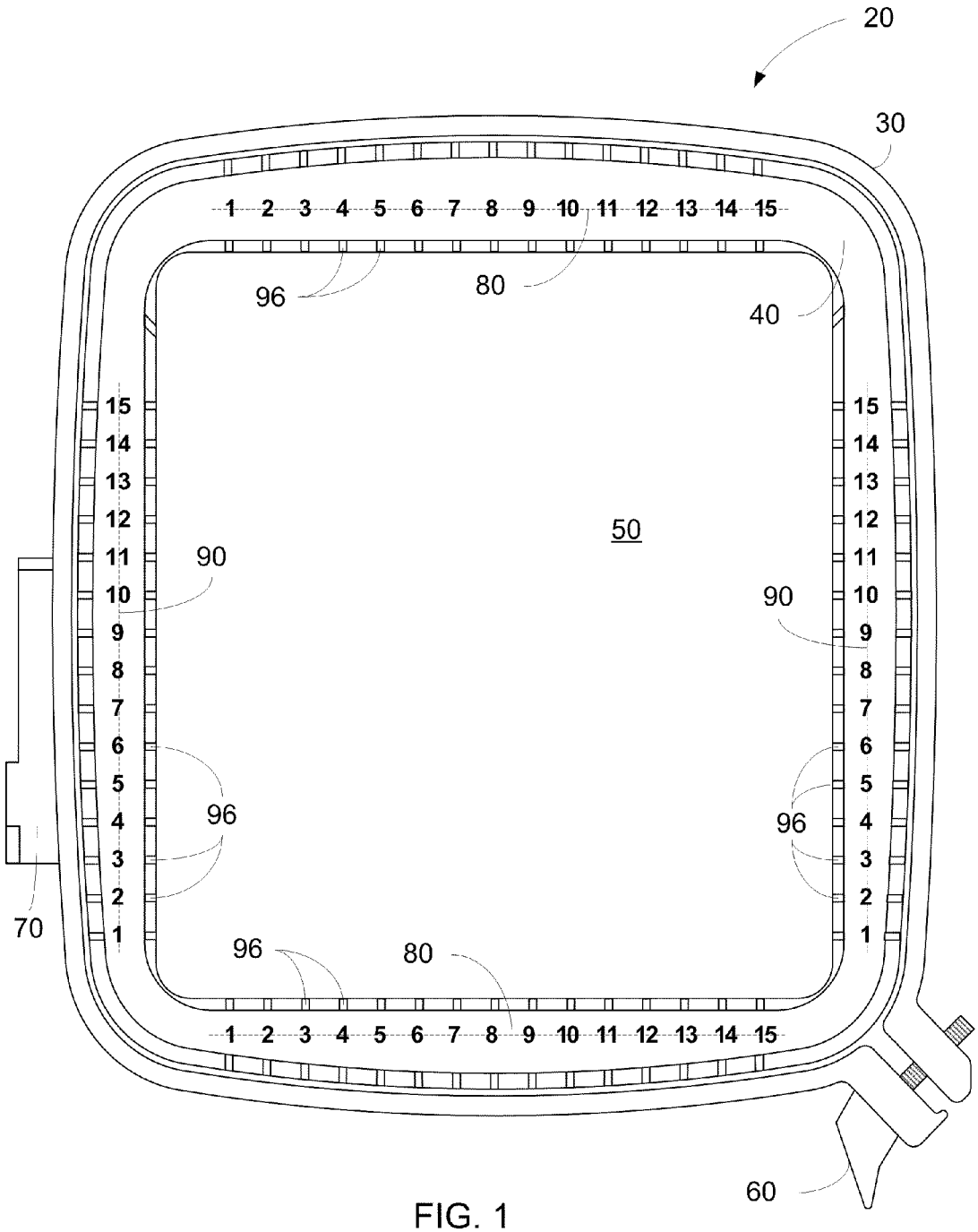
FIG. 1 is a front view of the texture hoop fixture.

With reference to the figures in which like numerals represent like elements throughout, FIG. 1 is a front view of an embodiment of the texture hoop fixture 20. The texture hoop fixture 20 has an outer hoop 30 and an inner hoop 40 with a central opening 50. A threaded clamp 60 allows tightening the outer hoop 30 about the inner hoop 40. The texture hoop fixture 20 includes a mounting lug 70 for mounting the texture hoop within or upon the embroidery unit of a processor controlled sewing and embroidery machine. In a manual sewing operation, the texture hoop fixture may be guided by hand.

As depicted in FIG. 1, in a first embodiment the texture hoop fixture 20 has a horizontal positional reference 80 defined along the upper and lower edges of the inner hoop 40 and a vertical positional reference 90 defined along the left and right sides of inner hoop 40. Each positional reference 80, 90 is marked off in units of 1 centimeter. In this embodiment, the texture hoop fixture defines a working envelope of 15 centimeters wide by 15 centimeters tall. When the texture hoop fixture 20 is mounted within a processor controlled sewing machine, the X and Y coordinate axes of the embroidery unit are parallel and may be expressed in the same units as the horizontal and vertical positional references 80, 90 displayed on the inner hoop 40. The inner hoop 40 also has a number of evenly spaced recesses 96 formed into the hoop surface. The recesses 96 are in horizontal and vertical alignment with the units of the horizontal and vertical positional references 80, 90. For clarity within the figure, only a portion of the recesses 96 are labeled. The positional references 80, 90 and recesses 96 are depicted as appearing on the inner hoop 40, but as will be appreciated by those skilled in the art, positional references and channels may also be placed upon the outer hoop 30, or on both the outer and inner hoops.

Figure 2:
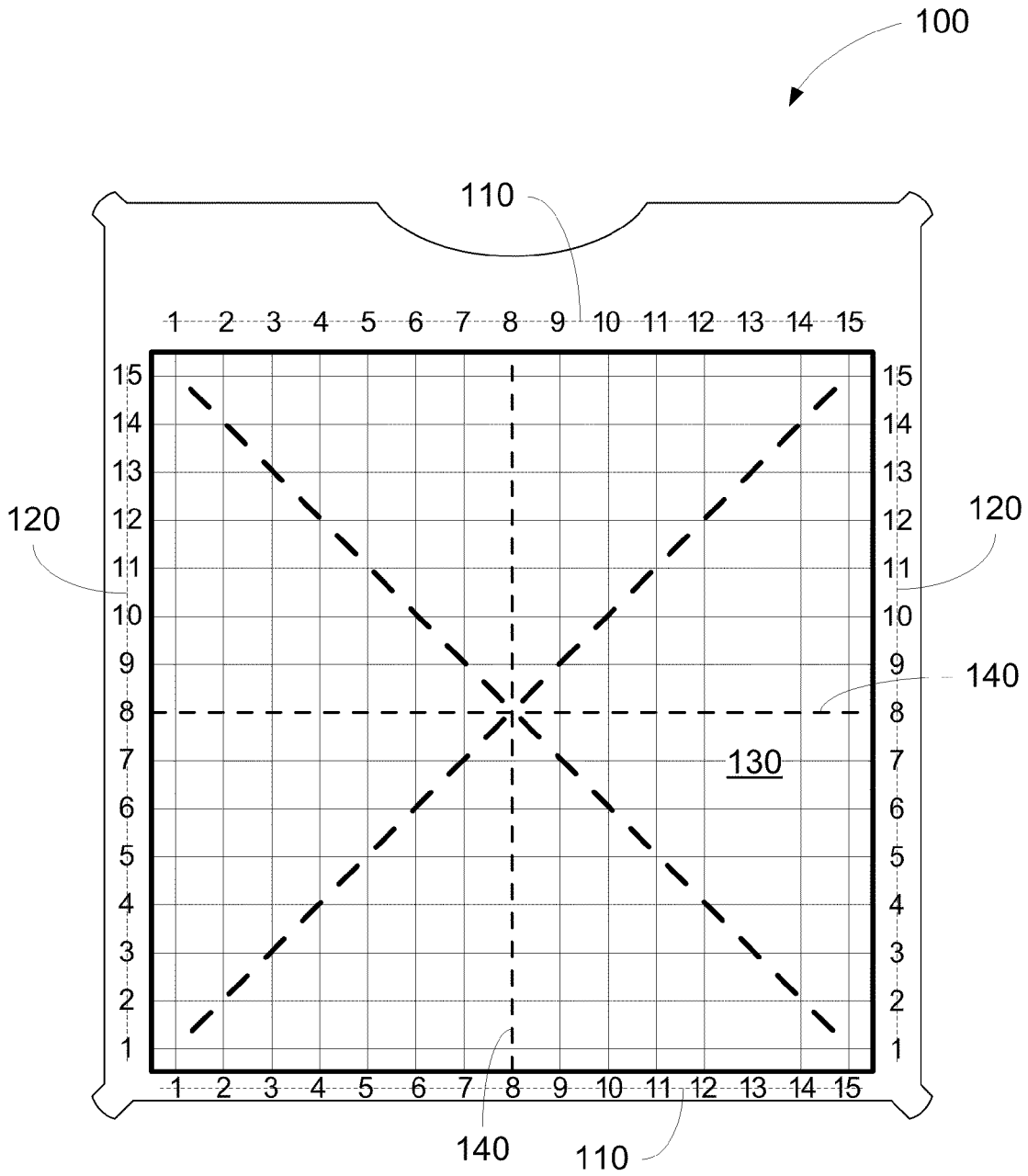
FIG. 2 is a front view of the template of the texture hoop fixture.

In an alternative embodiment of the present invention, as depicted in FIG. 2 a template 100 may be used as a positional reference as a part of the texture hoop fixture. The template has a horizontal positional reference 110 defined along the upper and lower edges of the template 100 and a perpendicular vertical positional reference 120 defined along the left and right sides of template 100. Each positional reference 110, 120 is again marked off in units of 1 centimeter, and grid lines 130 are provided across the interior of the template. Center reference lines 140 emphasize the center of the working envelope of the embroidery unit. When the template 100 is positioned upon the texture hoop fixture 20, in processor controlled machine, the X and Y coordinate axes of the embroidery unit are parallel and may be expressed in the same units as the horizontal and vertical positional references 110, 120 displayed on template 100. The template is constructed of a transparent or semi-transparent acrylic, however other materials may be used as are known in the art.

Figure 3:
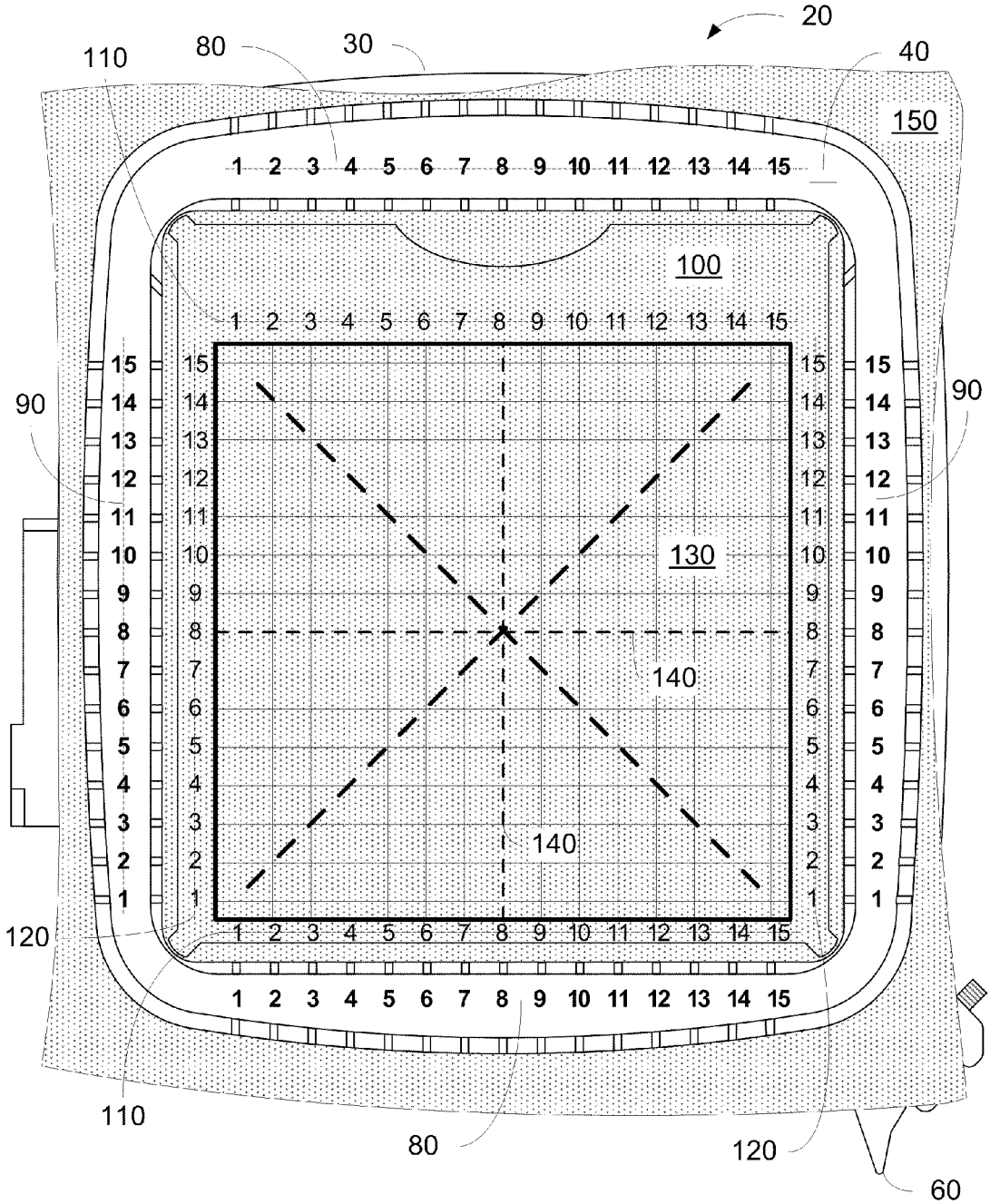
FIG. 3 is a front view of the texture hoop fixture with the fixture template.

As depicted in FIG. 3, the inner hoop 40 and the template 100 may be used together within the texture hoop 20 to provide a positional reference. A base fabric 150 intended to receive embellishments or embroidery is clamped between the inner hoop 40 and the outer hoop. The template 100 is then placed in the center of the inner hoop 40 and on top of the fabric 150. The outer dimensions of the template 100 closely match the central opening of the inner hoop 40 so that the template is aligned with and received in the opening. Other embodiments of hoops may be used to secure a base fabric 150 within a texture hoop fixture. Alternative embodiments may have a single hoop and utilize an elastic member, integral clamps, adhesives, or pins, to secure the base fabric taught within the fixture, or the fabric may be secured by other means as are readily known to those skilled in the art.

As further depicted in FIG. 3, the horizontal positional references 80, 110 and the vertical positional reference 90, 120 of the inner hoop and template align. In alternative embodiments, the texture hoop fixture 20 may have positional references on only the inner hoop 40, on only the template 100, or on both the inner hoop and template. The template grid lines 130 and center reference lines 140 further aid in determining the position of any item placed upon the fabric 150.

Figure 4:
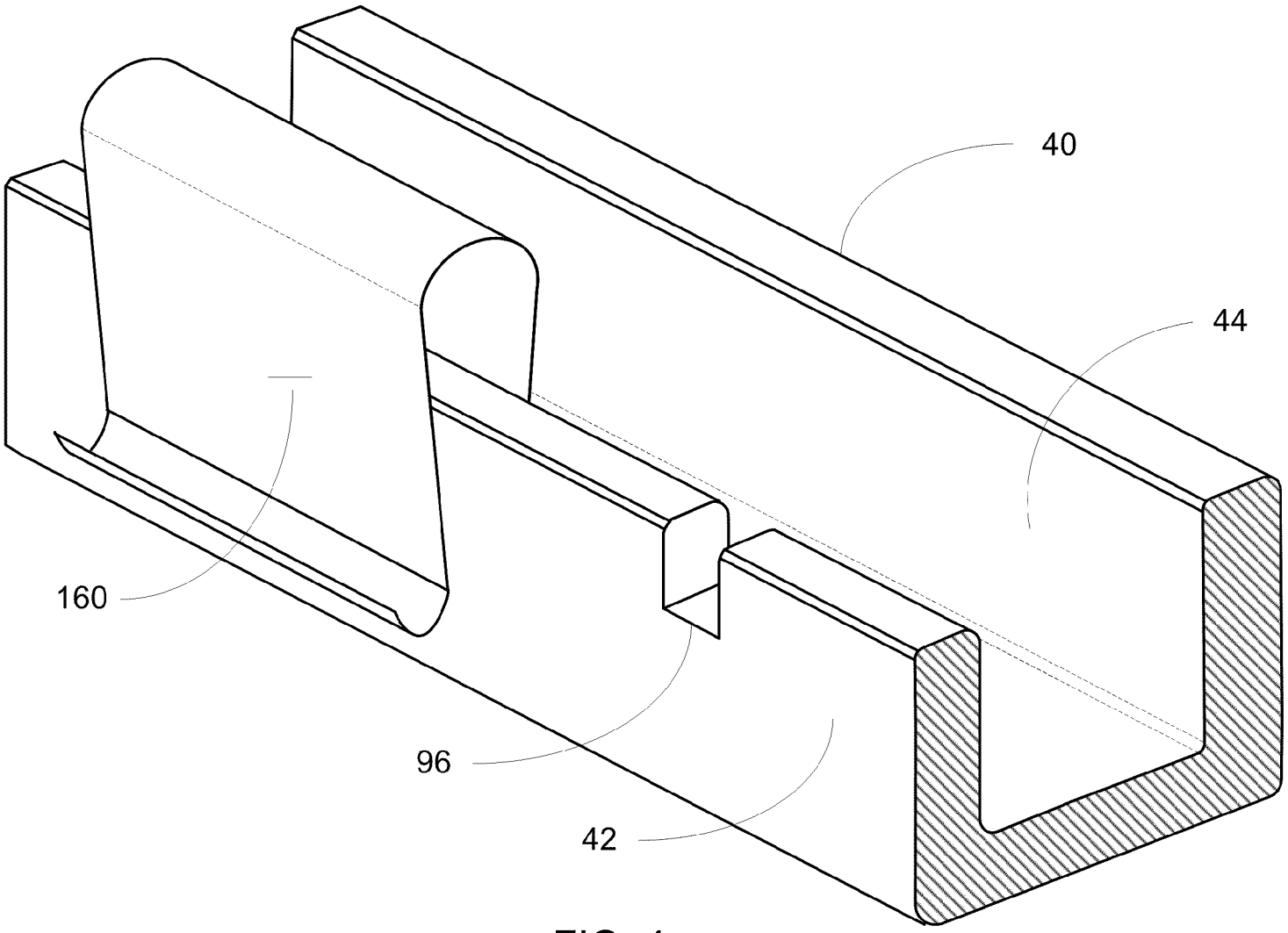
FIG. 4 is a perspective cross-sectional view through the inner hoop of the texture hoop fixture.

The inner hoop 40 of the texture hoop fixture is depicted in cross-section in FIG. 4. The inner hoop 40 has a raised lip 42 on the hoop inner edge and a second raised lip 44 on the hoop outer edge. The raised lip 42 has evenly spaced recesses 96 formed therein. A spring clip 160 is shown engaging the raised lip 42.

Figure 5A:
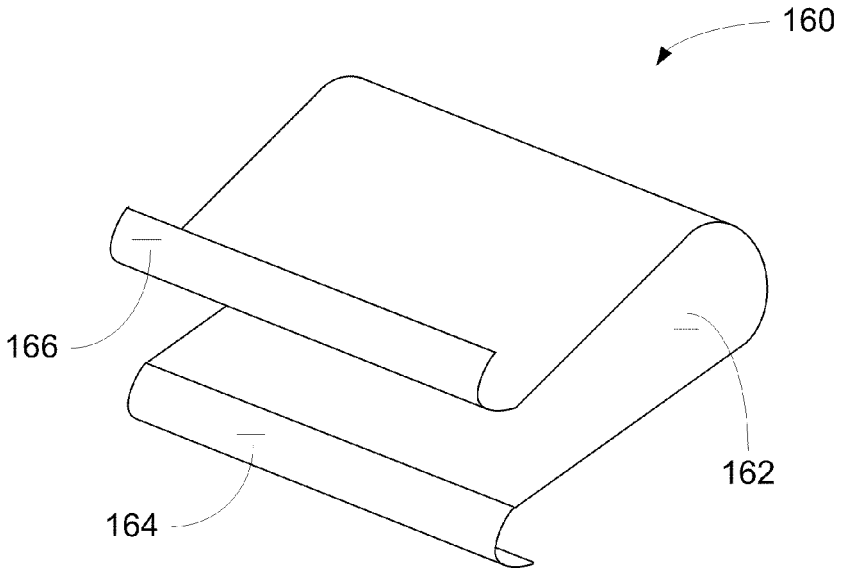
FIGS. 5A and 5B are side-perspective views of spring clamps used with the texture hoop fixture.
Figure 5B:
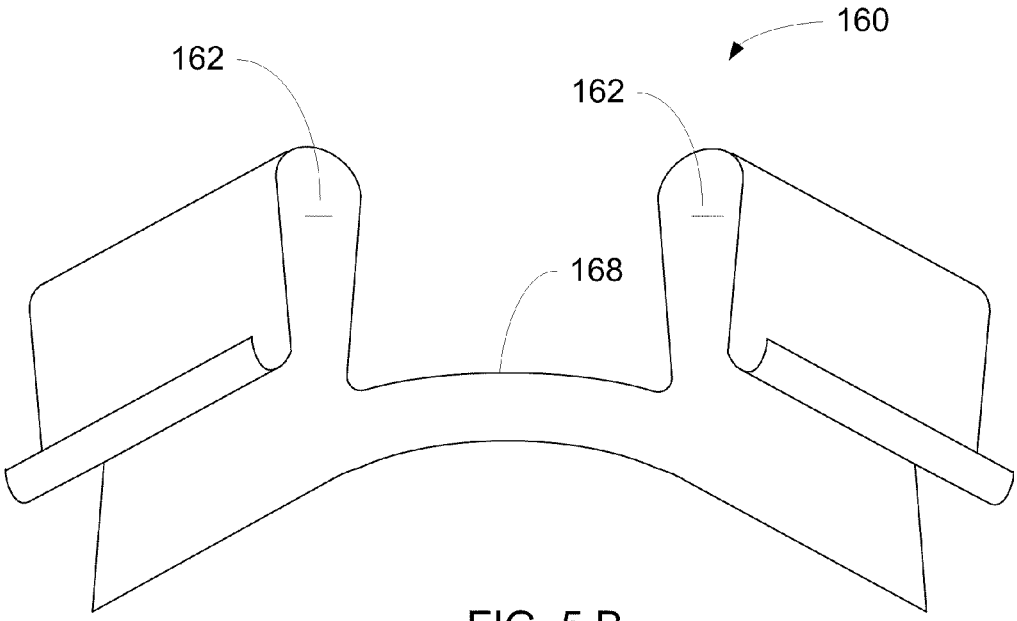

The spring clip 160 of FIG. 4 is depicted in perspective in FIG. 5A. The spring clip 160 is bent to form a generally U shaped channel 162. The leading edges 164, 166 of the clip are formed into an outward bent radius. The radiused leading edges 164, 166 allow the clip to be pushed over a fabric without damaging the fabric texture or weave. Another embodiment of the spring clip 160 is depicted in perspective in FIG. 5B. In this embodiment, the spring clip 160 includes two U shaped channels 162 which are joined by a center section 168. In this embodiment the clip 160 is intended for use in the corners of the texture hoop fixture. The spring clip is formed from spring steel. The spring clip may also be formed from other metals or molded from plastics as is readily known to those skilled in the art.

Figure 6:
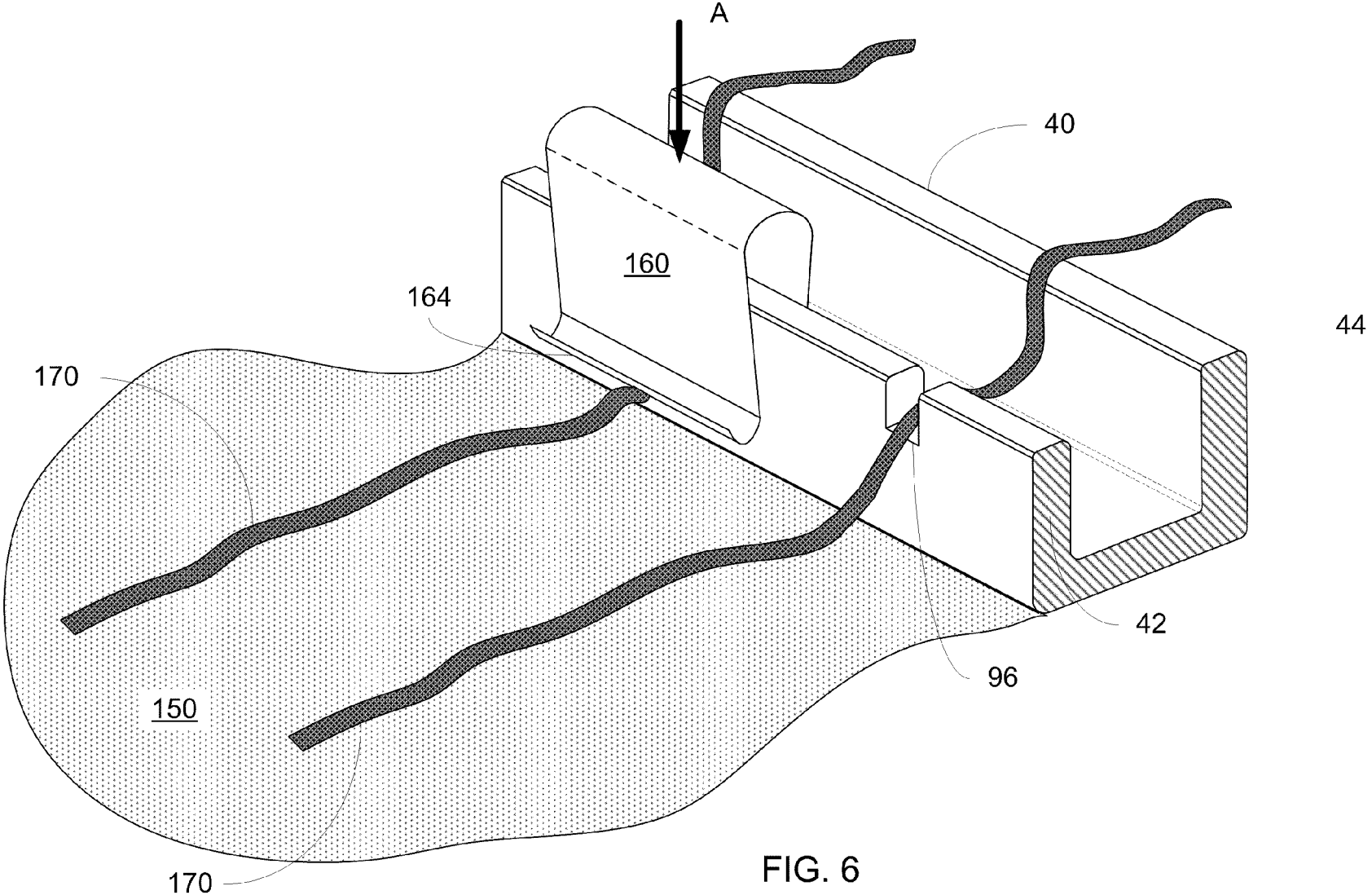
FIG. 6 is a perspective cross-sectional view thru the texture hoop fixture with an embellishment clamped in position upon fabric.

FIG. 6 is a depiction of fabric 160 stretched across the texture hoop device and a spring clip 160 engaging a portion of the inner hoop 40. Embellishments 170 in the form of yarn are laid upon the fabric 150. The embellishments 170 is received into and positively positioned by the recesses 96 in the inner lip 42. The embellishments are then clamped into position adjacent the fabric surface by spring clips 160. The spring clip 160 is positioned over the raised lip 42 of the inner hoop and pushed into position in the direction of arrow "A". The radiused leading edge 164 of the spring clip protects the embellishment from damage during the clamping operation. The embellishments 170 are now secured adjacent to the fabric upper surface and are ready to be sewn to the base fabric 150 using a manual or processor controlled sewing operation. The embellishment 170 will not shift in position during sewing operations and will not be lifted by or interfere with the foot of the sewing and embroidery machine. Embellishments may be readily added, removed, or repositioned upon the base fabric 150. A design may be developed and continuously modified during a sewing session as embellishments are added, repositioned or removed.

Figure 7:
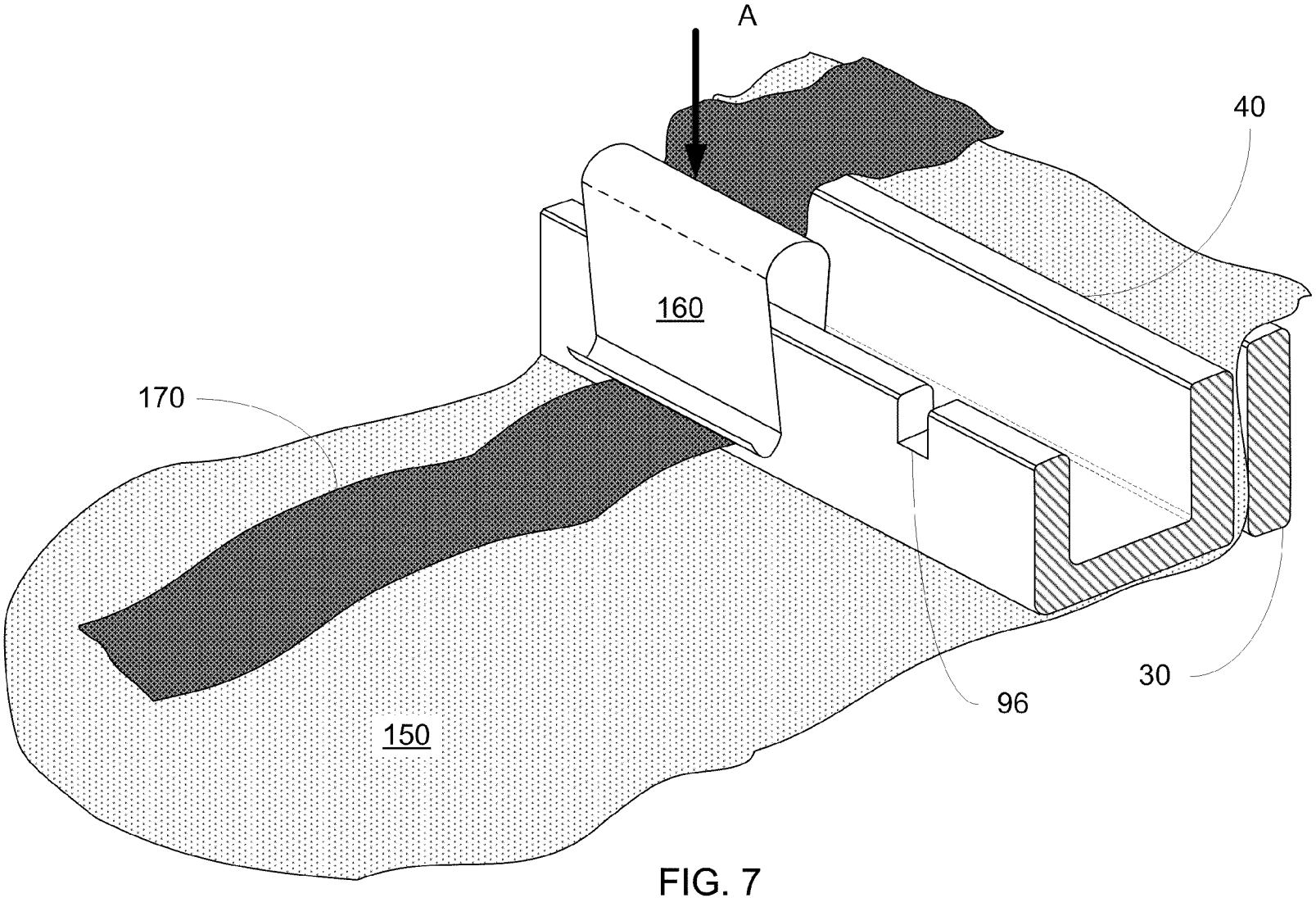
FIG. 7 is a perspective cross-sectional view thru the texture hoop fixture with a different embellishment clamped in position upon fabric.

FIG. 7 is a depiction of a wide ribbon embellishment 170 being clamped in position by the spring clip 160. The base fabric 150 intended to receive the embellishment is depicted clamped between the inner hoop 40 and outer hoop 30. An embellishment 170 in the form of a wide ribbon is laid upon the fabric 150. The ribbon embellishment 170 is laid in position by the user referencing the positional references on the inner hoop 40 and recesses 96. In this example, the embellishment 170 is too wide to be received into the recess 96, but the recess may still be used as a positional reference for the proper placement of the embellishment. The embellishment is again clamped into position adjacent the fabric surface by pushing the spring clip 160 in the direction of arrow "A" and is then ready to be sewn to the base fabric using either a manual or a processor controlled sewing operation. In alternative embodiments of the present invention, the spring clip 160 may engage another portion of the inner hoop 40 or the outer hoop 30.

Figure 8A:
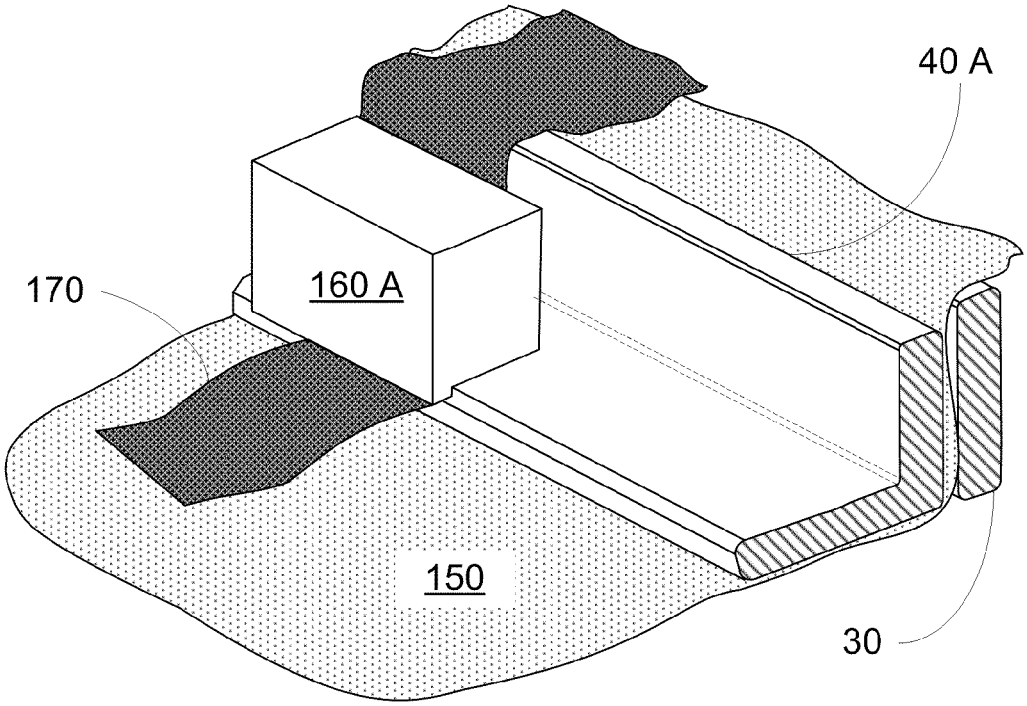
FIGS. 8A, 8B, 8C, and 8D are alternative embodiments for securing embellishment within the texture hoop fixture.
Figure 8B:
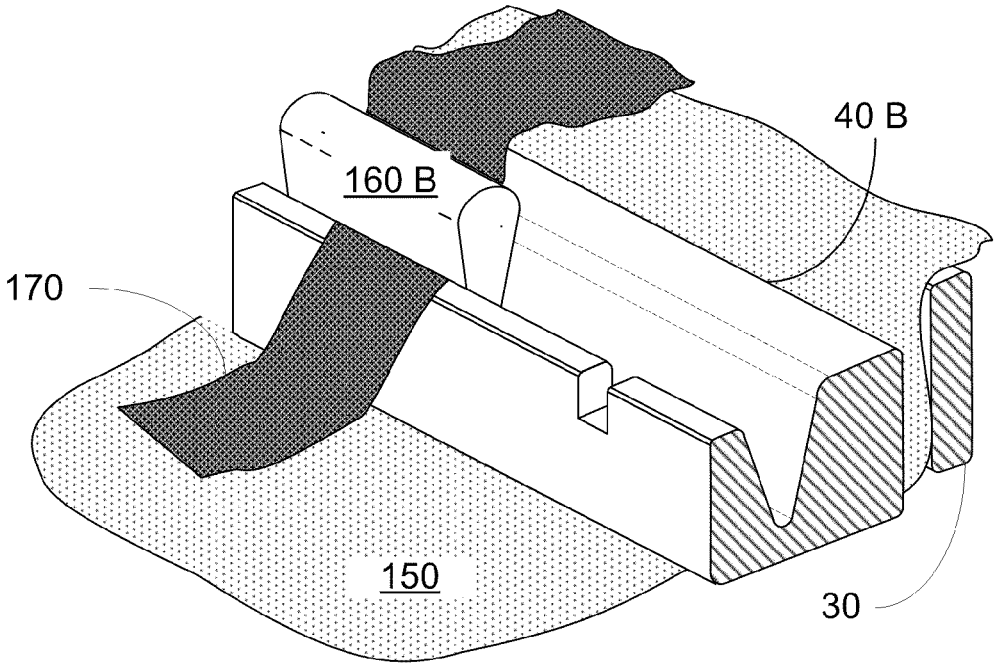
Figure 8C:
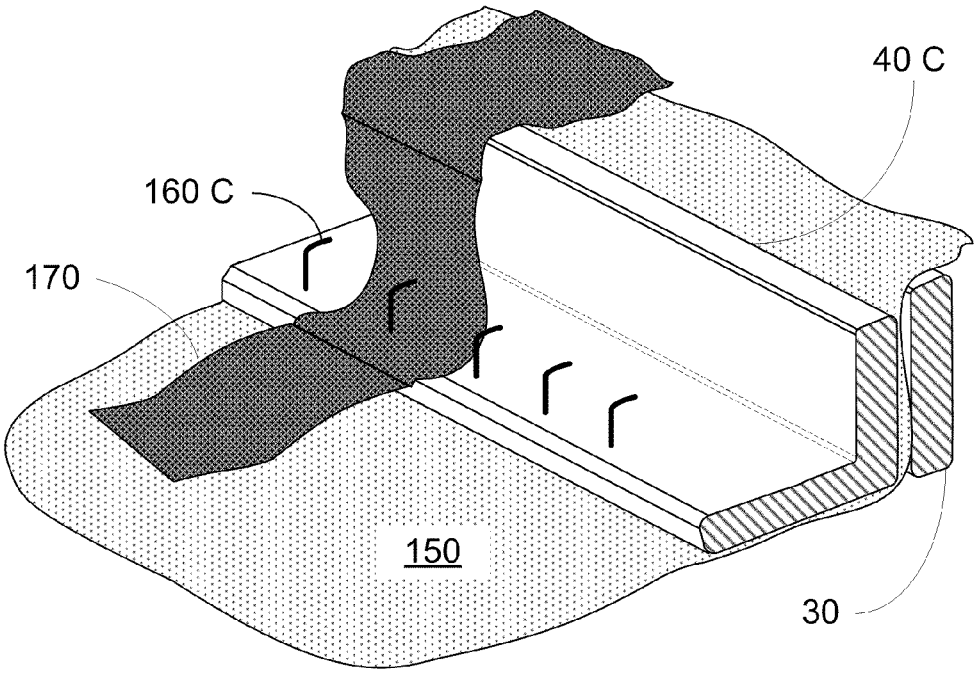
Figure 8D:
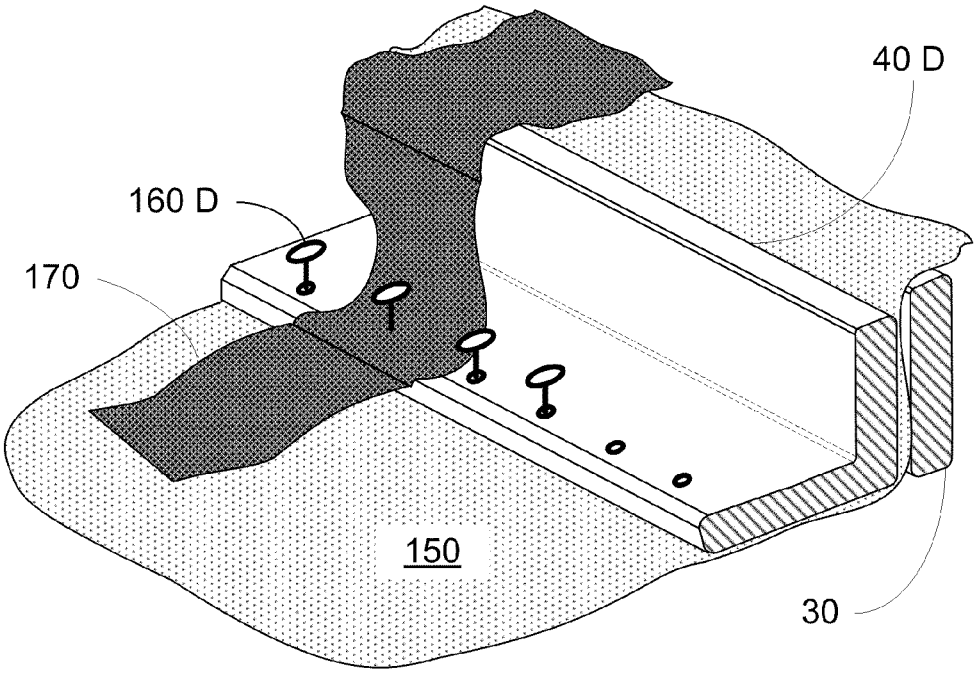

FIGS. 8A-8D depict other alternative embodiments of the present invention for securing an embellishment 170 within the texture hoop fixture. FIG. 8A depicts an L shaped cross-section inner hoop 40A with a complimentary L shaped magnet clamp 160A securing the embellishment 170 to the inner hoop. The inner hoop 40A is made of a magnetic material or alternatively has a material insert to allow function of the magnet clamp. FIG. 8B depicts an inner hoop 40B with a V shaped cross-section. A wedge clamp 160B is inserted into the V-shaped cross section to secure the embellishment 170 to the inner hoop. FIG. 8C depicts an inner hoop 40C having an L shaped cross-section and having multiple hooks 160C extending from a surface of the hoop. The embellishment 170 is positioned upon the inner hoop 40C and secured in place by being impaled upon one or more of the hooks. FIG. 8D again depicts an inner hoop 40D having an L shaped cross-section. In this embodiment the inner hoop has multiple holes for receiving pins 160D therein. The embellishment 170 is positioned upon the inner hoop 40D and secured by impaling with one or more of the pins. As will be appreciated by those skilled in the art, in alternative embodiments any of the methods herein for securing an embellishment to the inner hoop may be applied to securing an embellishment to the outer hoop of the device.

Figure 9:
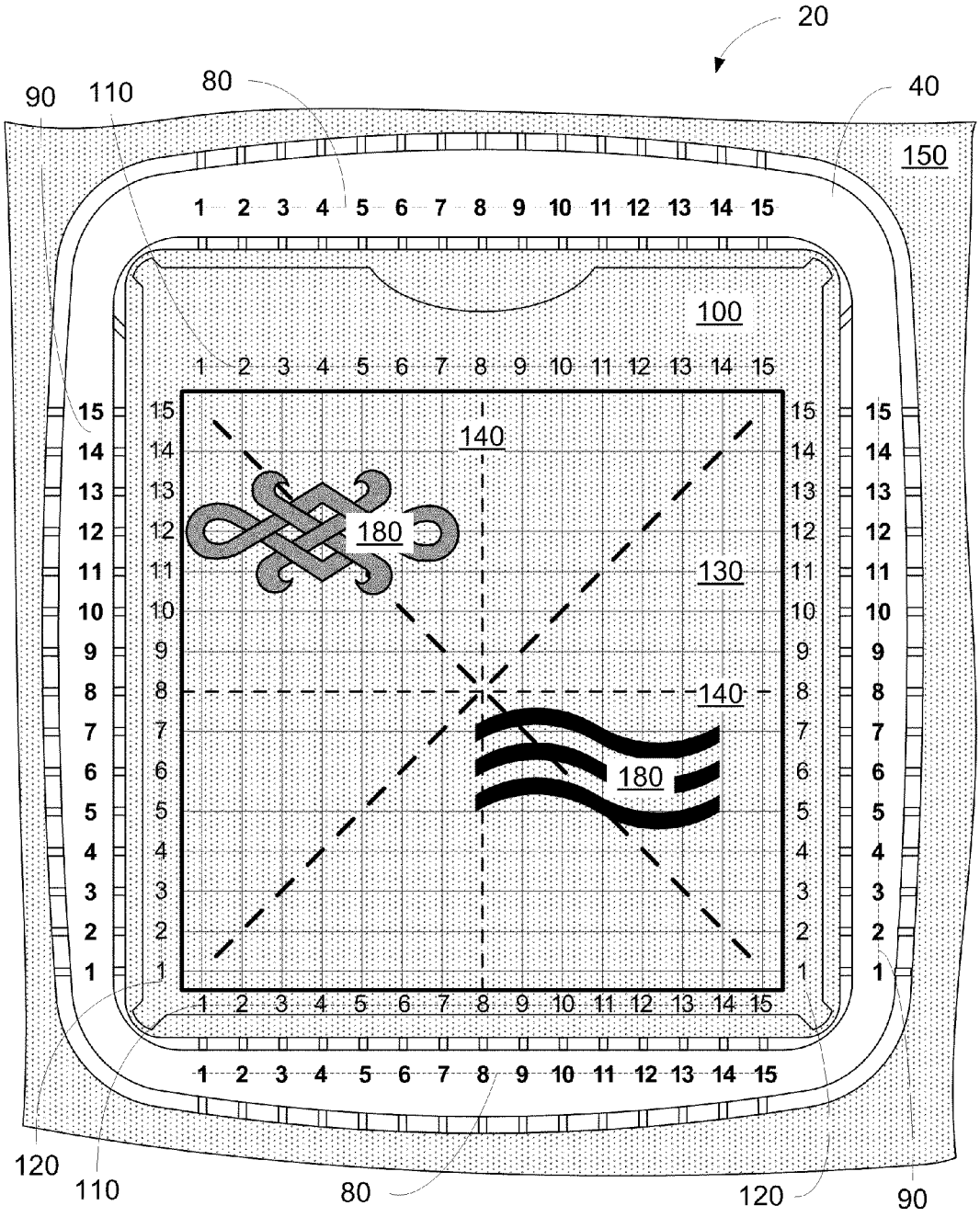
FIG. 9 is a front view of the texture hoop fixture and fixture template of FIG. 3 depicting embroidery elements placed upon fabric.

As depicted in FIG. 9, the inner hoop 40 and the template 100 are being used together to provide a positional reference for two embroidery elements 180. The base fabric 150 intended to receive embroidery elements 180 has been stretched across the texture hoop fixture 20. Paper graphics of the desired embroidery elements 180 have been cut out and positioned upon the fabric 150 to help the user visualize the design. Alternatively the texture hoop template user may simply visualize the embroidery element shape in place. The template 100 has been positioned within the inner hoop 40 and over the paper graphics. The horizontal positional references 80, 110 and the vertical positional reference 90, 120 of the inner hoop and template are then used to determine the coordinate values of the center of the embroidery elements. The template grid lines 130 and center reference lines 140 further aid the user in determining the embroidery element center. The semi-transparent template 100 allows viewing to the embroidery element 180 paper graphics in position within the design. The paper templates may be readily shifted upon the fabric to obtain a desirable spacing within the composite embroidery design. In a manually controlled sewing machine, the user may remove the template 100, and use the paper templates as position and shape references for free hand sewing of each embroidery design.

When using a processor controlled machine, each X and Y coordinate axis of the embroidery unit is reference within the processor to have an origin at the center of the working envelope of the texture hoop fixture 20. Each coordinate axis therefore aligns with the template center reference lines 140 and with the coordinate axis origin at the center of the template. The fist embroidery element in the form of a Celtic knot is therefore centered at coordinate values of [−40] millimeters in the X axis and [40] millimeters in the Y axis. The second embroidery element 180 in the form of a wave pattern is centered at coordinate values of [30] millimeters in the X axis and [−20] millimeters in the Y axis. Using the positional references of the texture hoop fixture as depicted in FIG. 9, the user may readily determine the coordinate values of desired embroidery elements within a pleasing design. The user may then program the embroidery machine with the center coordinate values of each desired embroidery element and the machine may then embroider the design into the fabric.

Figure 10:
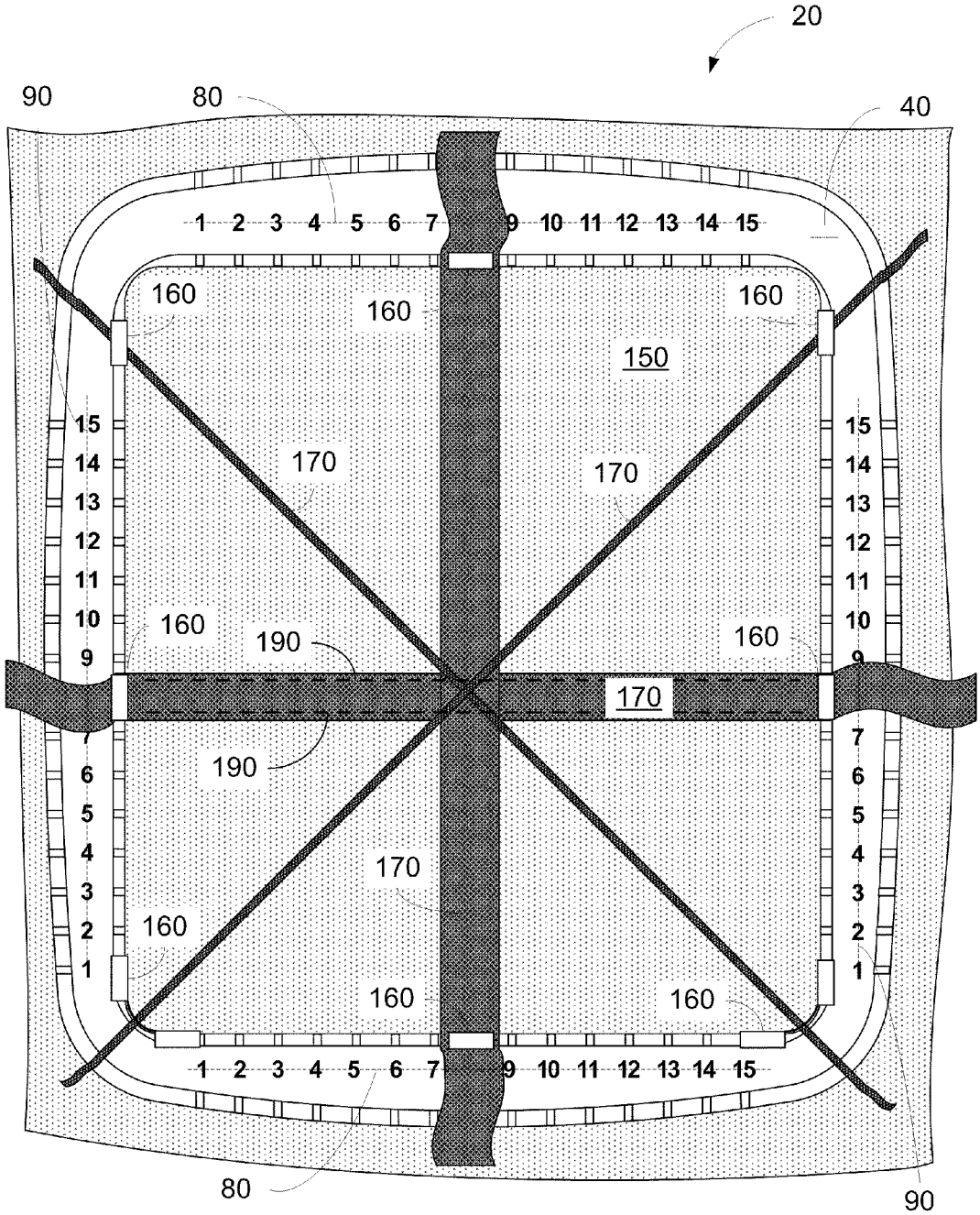
FIG. 10 is a front view of the texture hoop fixture of FIG. 1 depicting embellishments placed upon fabric.

FIG. 10 depicts adding multiple embellishments 170 of ribbons and yarns to a fabric using the texture hoop fixture 20. In this example, the template is not being employed. The embellishments are first positioned upon the fabric and manipulated to obtain a pleasing design. The embellishments may be freely repositioned, layered, and interwoven, one atop another, to achieve a unique effect. When developing the design, the positional references 80, 90 aid in determining the spacing and alignment of each embellishment relative to the others. When the user is satisfied with the design, each embellishment 170 is then clamped in position upon the inner hoop 40 using spring clips 160. The embellishment 170 are now affixed adjacent the fabric surface and will not move during sewing operations. In a manual sewing operation, a user may readily feed the texture hoop fixture, with clamped fabric and embellishments, under the presser foot of the machine to sew the design to the base fabric. The embellishments will not shift on the base fabric or become entangled with the presser foot during the sewing operation. Should the user desire to add another embellishment to the completed design, the new embellishment may simply be added in position, clamped in place, and sewn to the previous elements and base fabric.

When using a processor controlled sewing machine, the user then must determine the start and end coordinate values of a stitch pattern to secure each embellishment in place. The user is aware that the X and Y coordinate axis origin corresponds to the number 8 position reference in both the horizontal and vertical on the inner hoop positional references 80, 90. In the case of the wide horizontal ribbon embellishment at the center of FIG. 10, using the positional references 80, 90 on the inner hoop 40 the user can determine stitches to secure the ribbon embellishment should begin at [−75] millimeters in the X coordinate axis and [0] millimeters in the Y coordinate axis. The stitch pattern should run from the start location to an end location at [75] millimeters in the X coordinate axis and [0] millimeters in the Y coordinate axis. These coordinate values will place a stitch pattern down the center of the wide horizontal ribbon.

Alternatively, the user may select to execute a stitch patter at the upper and lower edge of the ribbon. A stitch pattern down the top edge of the ribbon can be determined using the positional references to have a starting coordinate values of [−75] millimeters in the X and [3] millimeters in the Y. The stitch pattern end coordinates values would be [75] in the X axis and [3] millimeters in the Y axis. A stitch pattern to secure the lower edge of the ribbon would run from X-Y coordinates [−75] [−3] at the start, to [75] [−3] at the end. The texture hoop user may then readily program the machine to execute the desired stitch patterns using the start and end coordinates above. Upon execution of the program, the ribbon will be neatly stitched to the base fabric in the desired location and spacing with upper and lower stitch patterns 190. The start and end stitch pattern coordinate values for the remaining embellishments may be determined and programmed into the machine and all embellishments stitched to the base fabric in the same sewing operation.

Figure 11:
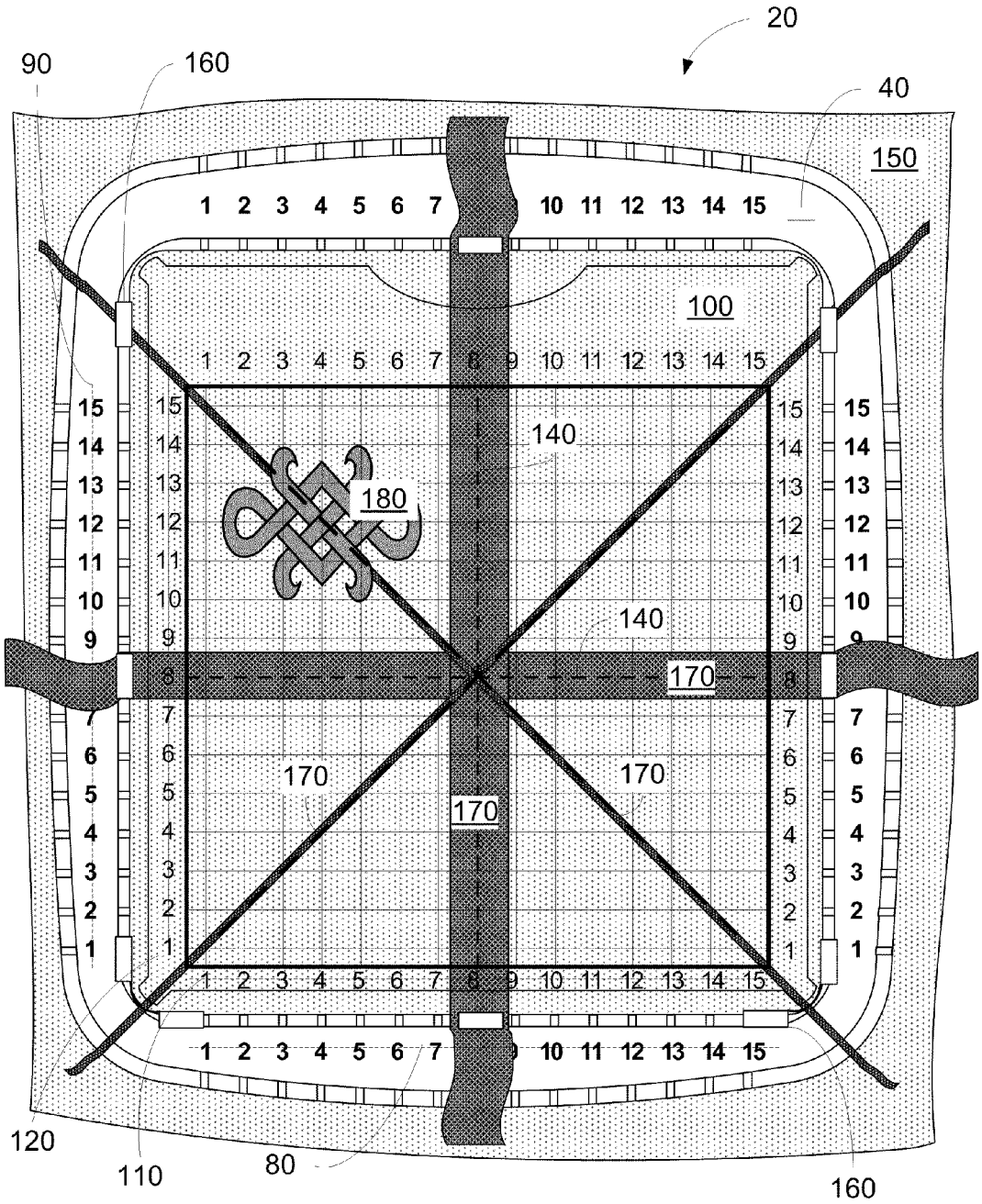
FIG. 11 is a front view of the texture hoop fixture and fixture template of FIG. 3 depicting an embroidery element and embellishments placed upon fabric.

In FIG. 11, the same fabric embellishments of FIG. 10 are being added to a fabric 150 and an embroidery element is also being included in the design. The embroidery element 180 is positioned within the design and overlaps one of the yarn embellishments 170 within the texture hoop fixture 20. With use and reference to the template 100 the center position of the embroidery elements is determined to be at X-Y coordinate values [−40] [40]. The spring clips 160 hold the yarn embellishment 170 passing beneath the embroidery element 180 taught and in contact with the fabric 150. In a manually controlled machine, the embroidery element may be sewn to the base fabric using the paper template as a position, size and shape reference. In a processor controlled machine, the user may program the coordinate values of the embroidery feature and allow the machine to execute both the stitch patterns securing the embellishments and the embroidery pattern overlapping the embellishment in the same sewing operation.

Figure 12:
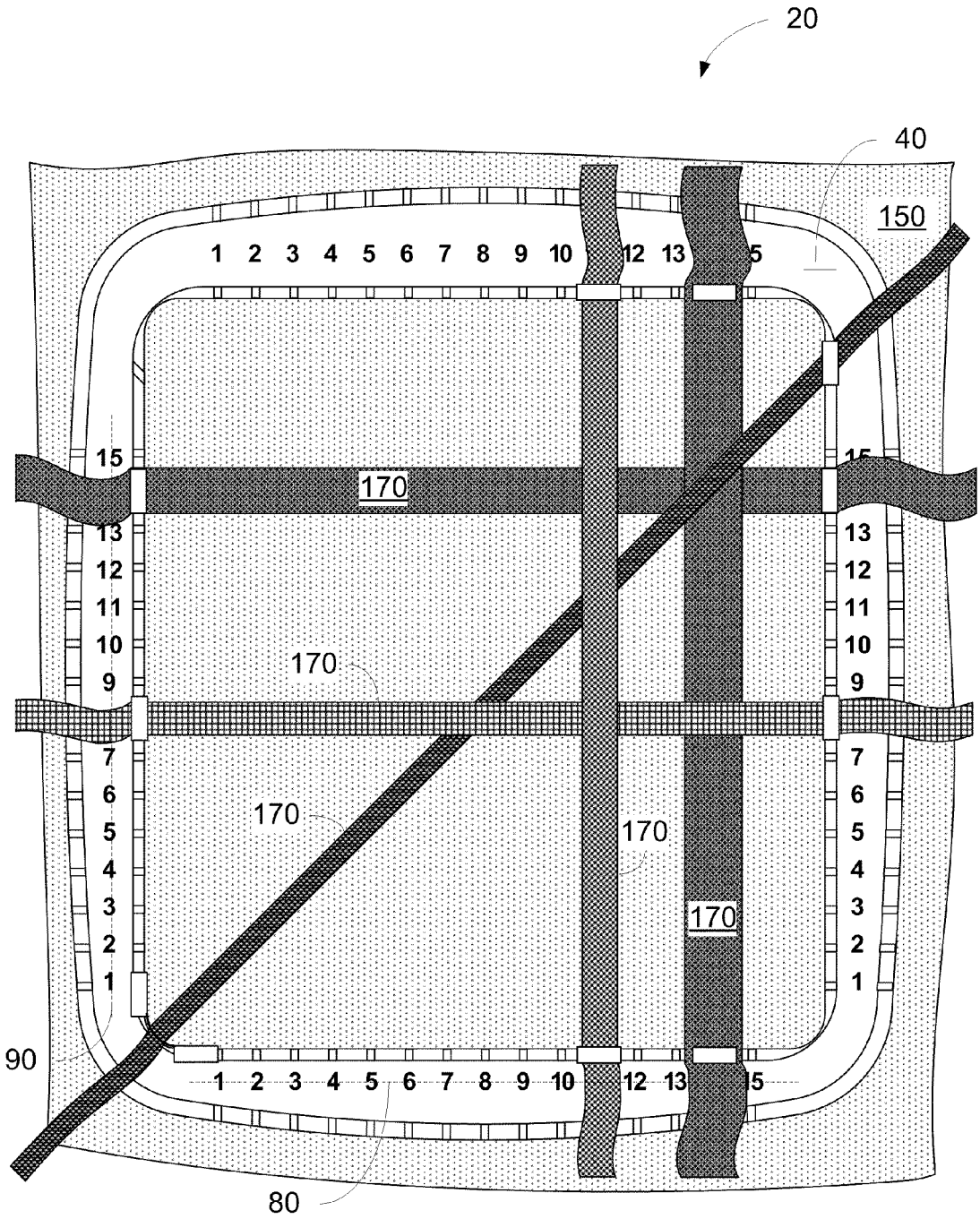
FIG. 12 is a front view of the texture hoop fixture of FIG. 1 and depicting overlapping embellishments placed upon fabric.
Figure 13:
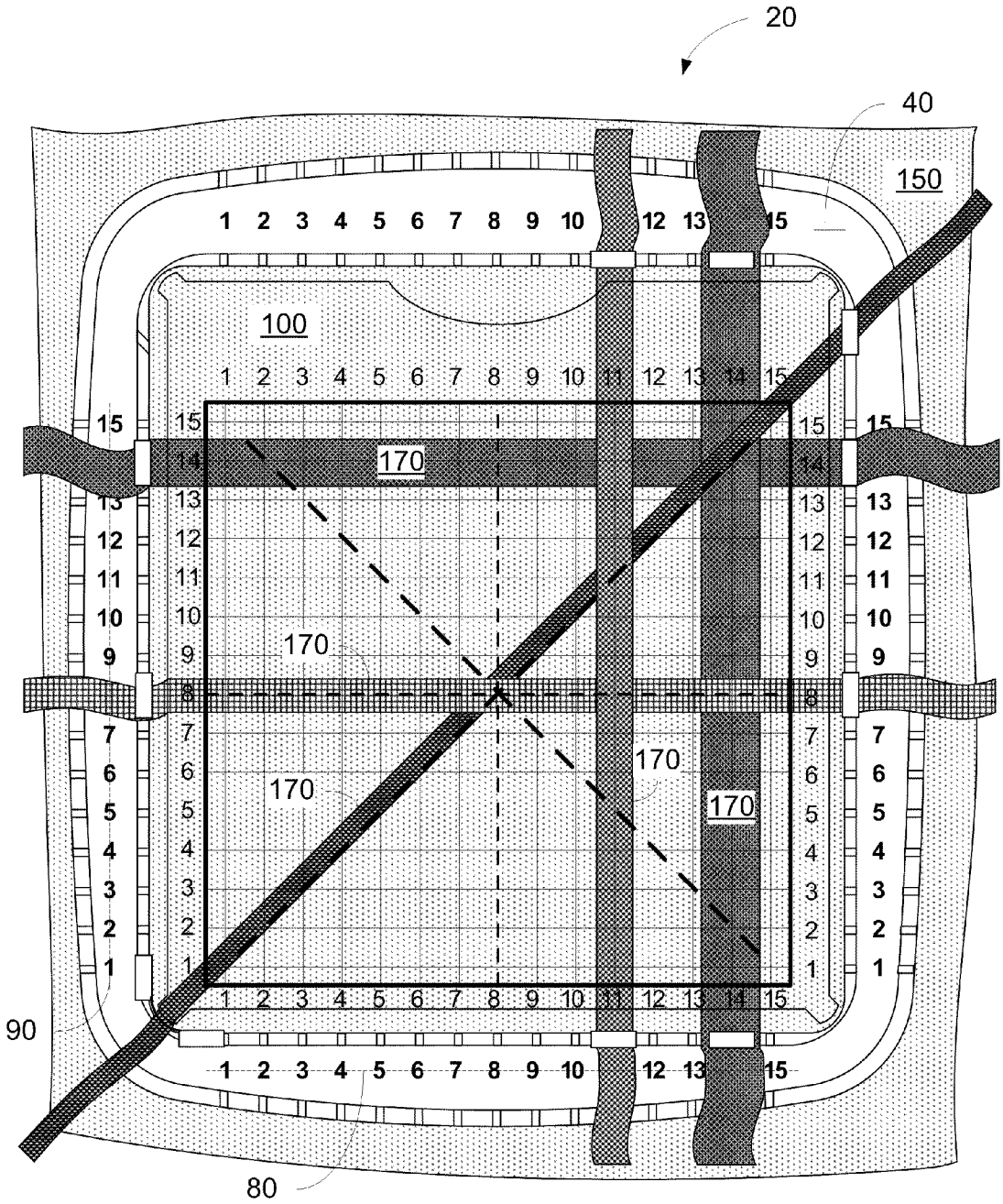
FIG. 13 is a front view of the texture hoop fixture and embellishments of FIG. 12 and depicting use of the fixture template.

FIG. 12 depicts adding multiple overlapping ribbons to a fabric using the texture hoop fixture 20. The ribbon embellishments 170 are first positioned upon the fabric and manipulated to obtain a pleasing design. Since the texture hoop fixture 20 holds all the ribbons in position during a sewing operation, the ribbons may be overlapped and intertwined by hand as best compliments the design and then secured within the texture hoop frame. In the design, the ribbons may thus be interlaced, or layered, to achieve a basket-weave effect of color and texture. This effect would be difficult or impossible to achieve without a means to positively and securely clamp the ribbons in place adjacent the fabric. The design may be easily accomplished using the texture hoop fixture 20 in either a manual or processor controlled sewing operation. In FIG. 13, the template 100 is positioned within the inner hoop 40 and over the design presented in FIG. 12. In a processor controlled sewing operation, the template 100 provides an additional positional reference to allow the user to determine the start and end points for stitch patterns to secure the interlaced ribbon embellishments within the design.

Figures 14A, 14B:
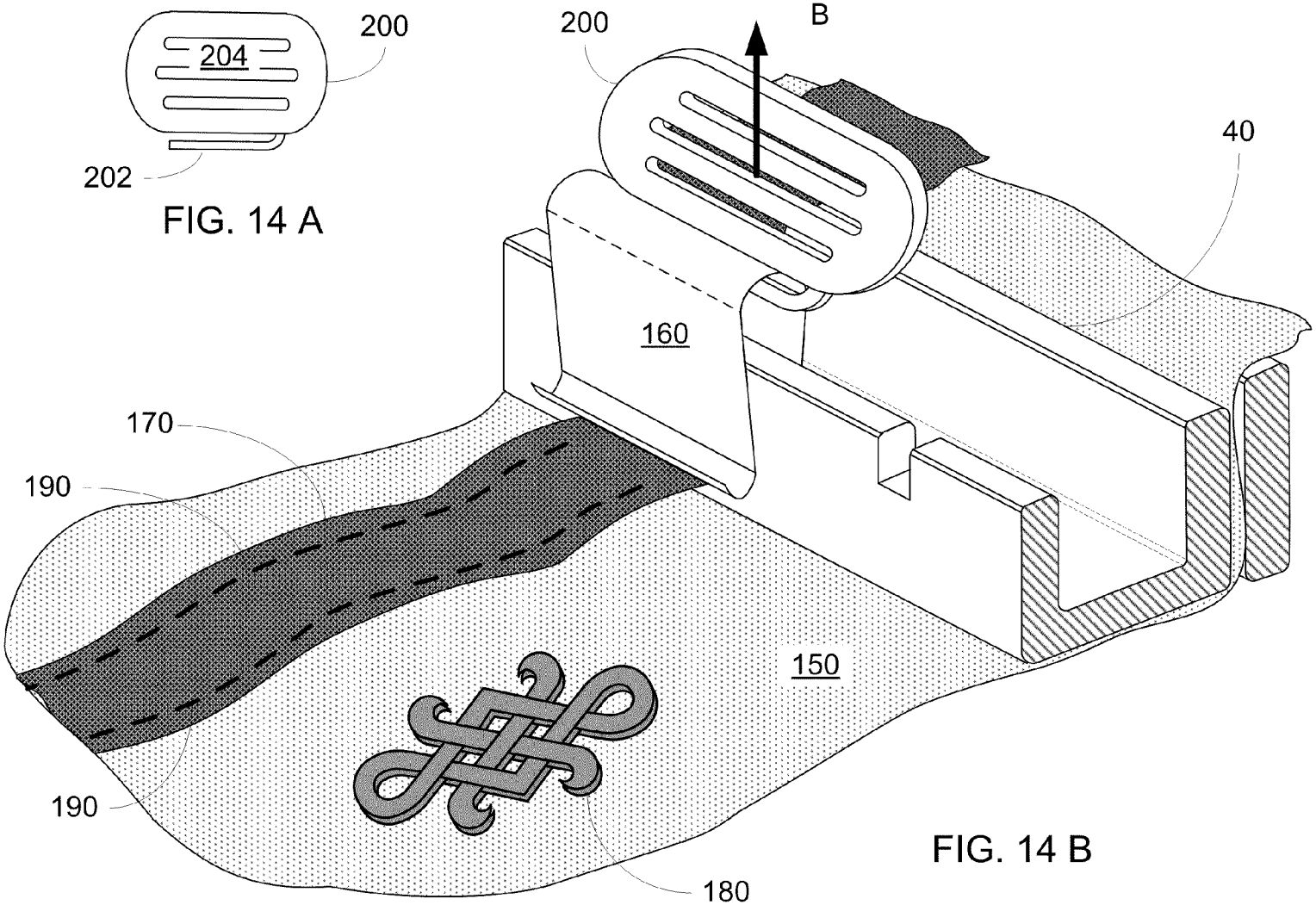
FIG. 14A is a front view of clamp removal tool of the texture hoop fixture.
FIG. 14B is a perspective cross-sectional view thru the texture hoop fixture with an embellishment and an embroidery sewn upon the fabric and depicting the use of the clamp removal tool.

A tool for the removal of spring clamps from the texture hoop is depicted in FIG. 14A. The tool 200 has a hook portion 202 and a gripping portion 204. In FIG. 14 B, an embellishment 170 in the form of a ribbon has been secured to the fabric 150 using an upper and lower stitch pattern 190. An embroidery element 190 has also been added to the base fabric. The user may now easily remove the spring clips 160 from the inner hoop 40 using the tool 200. The tool 200 hook portion 202 is inserted into the spring clip. The tool 200 is then pulled in the direction of arrow "B". The fabric with embellishments and embroidery sewn in place may now be removed from the texture hoop fixture.

While there has been shown a preferred embodiment of the present invention, it is to be understood that certain changes may be made in the forms and arrangement of the elements and steps of the method for the texture hoop fixture without departing from the underlying spirit and scope of the invention.

What is claimed is:

1. A texture hoop for use in a sewing machine, the texture hoop comprising:

a fixture having a central opening and a plurality of recesses spaced adjacent the central opening, the fixture configured to affix a base fabric stretched across the central opening to the fixture edges; and means for securing at least one embellishment to the fixture.

2. The texture hoop of claim 1, wherein the plurality of recesses are evenly spaced at intervals along at least one edge of the fixture.

3. The texture hoop of claim 1, wherein the means for securing the embellishment to the fixture comprises securing the embellishment within at least one of the recesses spaced around the central opening.

4. A texture hoop for use in a processor controlled sewing machine, the sewing machine having a presser foot and a processor controlled embroidery unit, the texture hoop configured for mounting upon the embroidery unit, the embroidery unit configured for moving the texture hoop along perpendicular first and second coordinate axes relative to the sewing needle, the texture hoop comprising:

a fixture having a central opening configured to affix a base fabric stretched across the central opening to the fixture edges;

the position of the fixture relative to the sewing needle being processor controlled along the perpendicular coordinate axes of the embroidery unit, each coordinate axis being divided into coordinate units relative to an origin, the needle position relative to the fixture then being expressed in the processor as a first coordinate value along the first axis, and a second coordinate value along the second axis;

means for securing an embellishment laying upon the base fabric to the fixture;

at least one positional reference on the fixture for relating the location of a received embellishment positioned upon the base fabric to the units of each coordinate axis;

wherein the at least one positional reference is used to generate a stitch pattern start location and a stitch pattern end location coordinate values to secure the received embellishment to the base fabric.

5. The texture hoop of claim 4, wherein the at least one positional reference comprises the coordinate units of the first and second coordinate axes marked upon the texture hoop fixture.

6. The texture hoop of claim 4, wherein the at least one positional reference comprises the origin of the first and second coordinate axes marked upon the texture hoop fixture.

7. The texture hoop of claim 4, wherein the at least one positional reference comprises a semi-transparent template marked with the coordinate units of the first and second axes and is configured to be received in the central opening of the fixture.

8. The texture hoop of claim 4, wherein the at least one positional reference comprises a semi-transparent template marked with the coordinate origin of the first and second coordinate axes and is configured to be received in the central opening of the fixture and having the coordinate origin of the first and second coordinate axes marked thereon.

9. The texture hoop of claim 4, wherein the at least one positional reference on the fixture comprises a plurality of evenly spaced recesses positioned along at least one edge of the fixture and adjacent the central opening.

10. The texture hoop of claim 9, wherein the means for securing the embellishment to the fixture comprises securing the embellishment within at least one of the recesses spaced around the central opening.

11. The texture hoop of claim 4, wherein the means for securing the embellishment to the fixture comprises at least one of a spring clip, a magnet, a wedge, a pin, or a hook.

12. The texture hoop of claim 4, wherein the means for securing the embellishment to the fixture comprises a protruding lip on the fixture and at least one spring clip configured to engage the protruding lip.

13. The texture hoop of claim 12, wherein the at least one positional reference on the fixture comprises a plurality of recesses spaced adjacent the central opening and configured to communicate with at least one spring clip to receive and secure an embellishment.

14. The texture hoop of claim 4, the fixture further comprising a first inner hoop and a second outer hoop, the inner and outer hoops having a central opening configured to clamp a base fabric stretched across the central opening between the first inner hoop and the second outer hoop.

15. A method of sewing an embellishment to a base fabric using a processor controlled sewing machine having sewing needle and a texture hoop configured for mounting upon an embroidery unit of the sewing machine, the embroidery unit configured to move the texture hoop along perpendicular first and second coordinate axes relative to the sewing needle, the texture hoop having a fixture comprising a first inner hoop and a second outer hoop, the inner and outer hoops having a central opening, the method comprising:

stretching a base fabric across the central opening of the fixture and clamping the base fabric between the first inner hoop and the second outer hoop;

positioning at least one embellishment upon the base fabric;

securing the at least one embellishment to the fixture;

determining the position of the texture hoop fixture relative to the sewing needle;

expressing the position of the texture hoop fixture relative to the sewing needle in the sewing machine processor as a first coordinate value along the first axes, and a second coordinate value along the second axes;

determining embellishment location coordinate values by using positional references of the texture hoop fixture that relate the embellishment location to the units of each coordinate axis;

programming the processor of the sewing machine with coordinate values corresponding to the embellishment location;

using the programmed embellishment coordinate values and the texture hoop position relative to the sewing needle to generating a stitch program to sew the embellishment onto the base fabric; and executing the stitch program to sew the embellishment onto the base fabric.

* * * * *